US006048119A

United States Patent [19]

Kato et al.

[11] Patent Number: 6,048,119

[45] Date of Patent: Apr. 11, 2000

[54] SHEET DISCHARGE MECHANISM AND APPARATUS INCORPORATING THE SAME

[75] Inventors: Hiroyuki Kato; Yasuhito Bandai, both of Nagoya, Japan

[73] Assignee: Brother Kogyo Kabushiki Kaisha, Nagoya, Japan

[21] Appl. No.: 09/110,259

[22] Filed: Jul. 6, 1998

[30] Foreign Application Priority Data

Jul. 9, 1997 [JP] Japan ..... 9-183566

[51] Int. Cl.[7] ..... B41J 13/10

[52] U.S. Cl. ..... 400/624; 271/208; 361/214; 361/221; 400/625

[58] Field of Search ..... 400/625, 636, 400/624, 645; 361/212, 214, 221; 271/208

[56] References Cited

U.S. PATENT DOCUMENTS

| | | | |
|---|---|---|---|
| 4,307,432 | 12/1981 | Nishikawa | 361/221 |
| 4,455,081 | 6/1984 | Yoshimura et al. | 355/14 SH |
| 4,751,548 | 6/1988 | Lawson | 361/212 |
| 4,951,935 | 8/1990 | Oikawa | 271/208 |
| 5,354,607 | 10/1994 | Swift et al. | 428/294 |
| 5,420,743 | 5/1995 | Domes | 361/214 |

*Primary Examiner*—Ren Yan
*Attorney, Agent, or Firm*—Oliff & Berridge, PLC

[57] ABSTRACT

A sheet discharge mechanism is provided which is capable of preventing improper sheet transfer. The sheet discharge mechanism includes discharge rollers for moving a recording paper sheet, and an electric discharge brush adjacent to the discharge roller. The electric discharge brush includes a plurality of filaments for removing electrostatic charge generated at the discharge rollers. The filaments of the brush also prevent the recording paper sheet from being moved in unintended directions.

17 Claims, 4 Drawing Sheets

SHEET DISCHARGE MECHANISM AND APPARATUS INCORPORATING THE SAME

BACKGROUND OF THE INVENTION

1. Field of the Invention

The present invention relates to a sheet discharge mechanism used in printers, facsimile machines or the like. In particular, the present invention relates to a sheet discharge mechanism provided with electrically conductive brush capable of removing electrostatic charge generated at discharge rollers. The present invention also relates to apparatus incorporating such a sheet discharge mechanism.

2. Description of the Related Art

Conventionally, sheet discharge mechanisms are incorporated in various apparatus, such as printers, facsimile machines or the like for purposes of discharging sheet members (such as recording paper sheets) out of the apparatus. To this end, a typical sheet discharge mechanism may include a rotary shaft driven by a suitable actuator such as a stepping motor, and discharge rollers fixedly mounted around the shaft. In operation, a sheet member to be discharged is held in contact with the discharge rollers. In this state, while the discharge rollers are rotated, the sheet member is moved in a predetermined discharging direction due to friction between the sheet member and the discharge rollers.

In a normal situation, the sheet member will eventually come out of contact with the discharge rollers, and then fall into a discharged sheet tray of the apparatus for example.

A problem associated with the conventional sheet discharge mechanism is as follows. In operation, the sheet member and the discharge rollers may be electrostatically charged due to the friction between the sheet member and the discharge rollers. In such a case, the rear end portion of the sheet member may unduly be kept attached to the discharge rollers even when the rear portion is supposed to leave the discharge rollers. If this happens, the sheet member tends to be unfavorably transferred backward or even wound around the discharge rollers.

One of the possible ways to address the above problem may be to provide an electrically conductive brush in the apparatus in a manner such that the brush comes into direct contact with a charged sheet member. However, it has been found that such a brush cannot completely remove the electrostatic charge from the sheet member. Thus, the improper sheet transfer described above may still result in the conventional sheet discharge mechanism.

SUMMARY OF THE INVENTION

It is, therefore, an object of the present invention is to provide a sheet discharge mechanism capable of overcoming the problem described above.

According to a first aspect of the present invention, there is provided a sheet discharge mechanism arranged for preventing improper sheet transfer comprising:

- at least one discharge roller for moving a sheet member; and
- an electric discharge brush arranged adjacent to the discharge roller, the brush being provided with a plurality of filaments for removing electrostatic charge and for preventing the sheet member from being moved in an unintended direction.

With such an arrangement, the filaments of the brush can be used not only for removing the electrostatic charge generated on the discharge roller but for preventing the sheet member from being unduly moved circumferentially of the discharge roller. Thus, according to the present invention, improper transfer of the sheet member can be prevented more reliably than is conventionally possible.

According to a preferred embodiment of the present invention, the filaments of the brush are held in contact with the discharge roller. Alternatively, the filaments of the brush may be spaced from the discharge roller.

The filaments of the sheet discharge mechanism are electrically connected to each other. For realizing this arrangement, the brush may include an electrically conductive base for holding the filaments of the brush together. Preferably, the electrically conductive base may be made of aluminum and have a smooth outer surface. The electrically conductive base may be made of stainless steel.

The sheet discharge mechanism may comprise at least two discharge rollers, wherein the brush has a longitudinal dimension which is no smaller than a maximum distance between the discharge rollers.

The sheet discharge mechanism may further comprise a rotary shaft for carrying the discharge roller fixed thereto, wherein the filaments are divided into a first group corresponding in position to the discharge roller and a second group corresponding in position to an exposed portion of the shaft, the filaments of the first group being shorter than the filaments of the second group.

According to a second aspect of the present invention, there is provided a printer for printing on sheets comprising:

- a sheet feed mechanism for feeding each sheet;
- a printhead for printing on said each sheet fed by the sheet feed mechanism; and
- a sheet discharge mechanism for discharging said each sheet, the sheet discharge mechanism comprising: at least one discharge roller for moving said each sheet; and an electric discharge brush arranged adjacent to the discharge roller, the brush being provided with a plurality of filaments for removing electrostatic charge and for preventing said each sheet from being transferred in an unintended direction.

According to a third aspect of the present invention, there is provided a facsimile machine incorporating a printer for printing on sheets, the printer comprising:

- a sheet feed mechanism for feeding each sheet;
- a printhead for printing on said each sheet fed by the sheet feed mechanism; and
- a sheet discharge mechanism for discharging said each sheet, the sheet discharge mechanism comprising: at least one discharge roller for moving said each sheet; and an electric discharge brush arranged adjacent to the discharge roller, the brush being provided with a plurality of filaments for removing electrostatic charge and for preventing said each sheet from being transferred in an unintended direction.

Other objects, features and advantages of the present invention will be apparent from the detailed description of the embodiment given below with reference to the accompanying drawings.

DETAILED DESCRIPTION OF THE PREFERRED EMBODIMENT

The preferred embodiments of the present invention will be described below with reference to the accompanying drawings.

Figure 1:
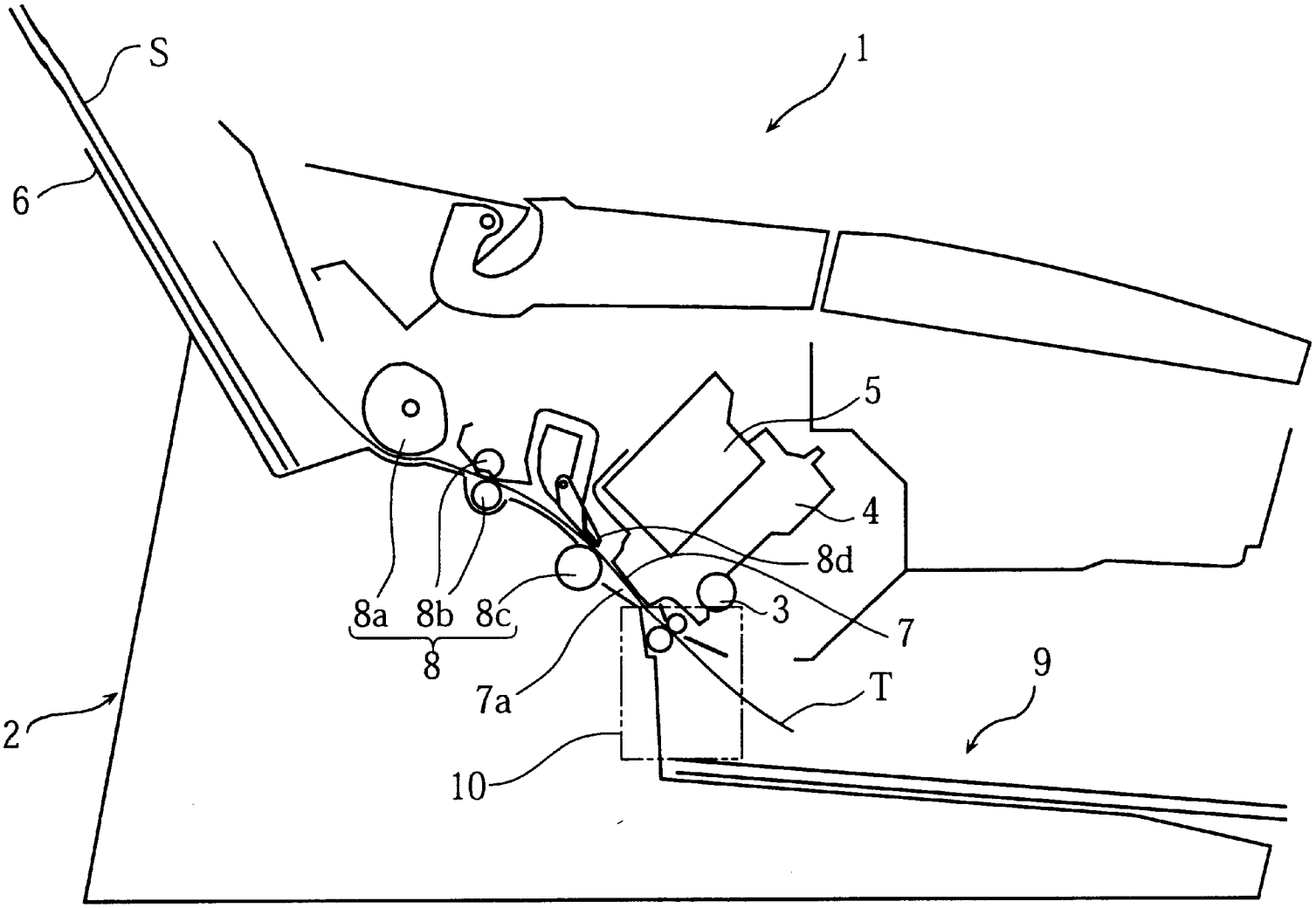
FIG. 1 is a sectional side view showing a facsimile machine embodying the present invention.
Figure 2:
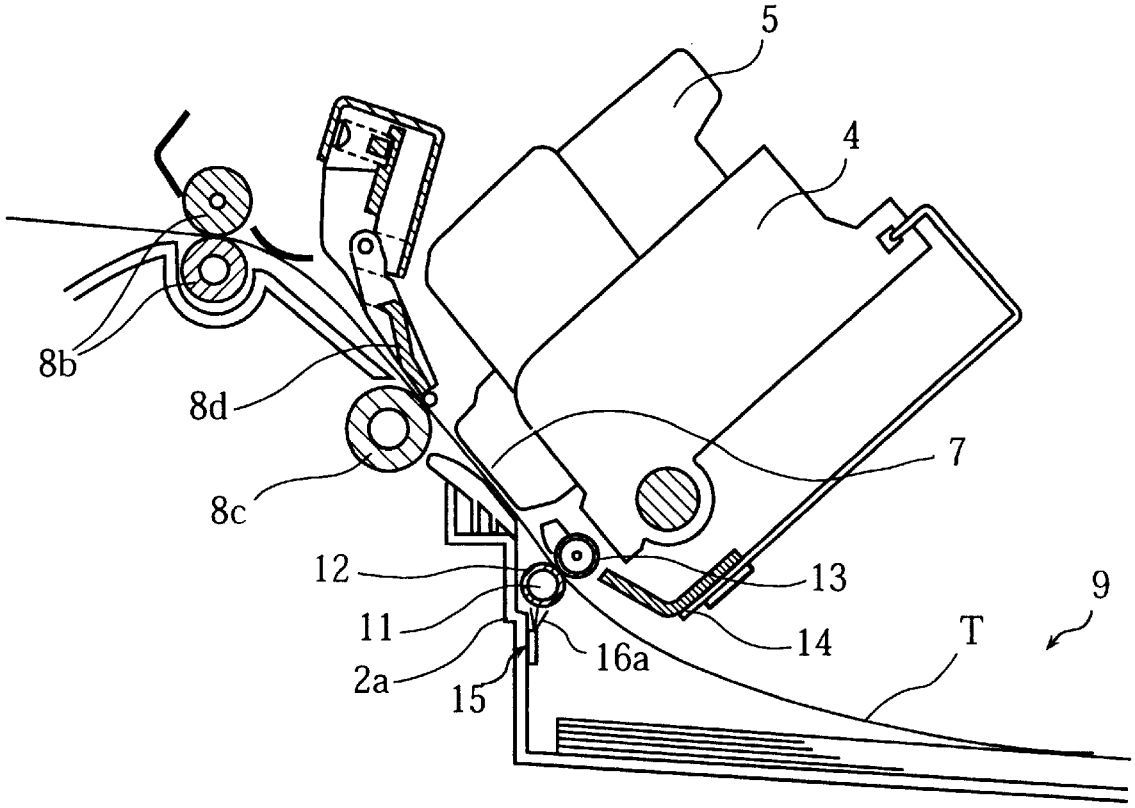
FIG. 2 is an enlarged side view showing principal parts of a printer incorporated in the facsimile machine.

Reference is first made to FIGS. 1 and 2. Of these figures, FIG. 1 is a sectional side view schematically showing a facsimile machine 1 embodying the present invention, while FIG. 2 is an enlarged view showing principal parts of a printer incorporated in the facsimile machine 1. Preferably, the incorporated printer may be an inkjet printer. However, this is not limitative, and other types of printers may also be used.

As shown in FIGS. 1 and 2, the incorporated printer includes a horizontal guide rail 3 fixed to the housing 2 at its both ends (not shown), a carriage 4 movable along the guide rail 3, and an ink cartridge 5 carried by the carriage 4 for supplying ink to a printhead 7. The printhead 7 is also carried by the carriage 4.

The printer further includes a paper feed tray 6 for holding recording paper sheets (S), a sheet feed mechanism 8, and a paper stacker 9 for holding discharged recording paper sheets (S).

For performing proper discharging of the paper sheets (S), the printer is provided with a discharge mechanism 10 capable of preventing improper transfer of the sheets (S), as will be described later.

In operation, a recording paper sheet (S) is fed from the paper feed tray 6 to a printing section 7*a* by the sheet feed mechanism 8. At the printing section 7*a*, selected text or images are printed on the recording paper sheet (S) by the printhead 7. Thereafter, the paper sheet (S) is discharged into the stacker 9 by the discharge mechanism 10.

A transfer path along which the recording paper sheet (S) is moved is shown by reference T in FIGS. 1 and 2. As is shown, the guide rail 3 extends in a direction perpendicular to the transfer path (T). (This particular direction may be referred to as "the transverse direction" below.) The printhead 7 is held in facing relation to the transfer path (T).

The carriage 4 can be reciprocated along the guide rail 3 by a suitable actuation mechanism (not shown) including a stepping motor, a transmission and the like. Thus, the printhead 7 carried by the carriage 4 is also reciprocated in the transverse direction for printing on the recording paper sheet (S).

The sheet feed mechanism 8 includes a first roller 8*a*, a pair of second rollers 8*b* and a third roller 8*c*. These rollers are arranged along the transfer path (T) between the paper feed tray 6 and the printing section 7*a*. The first roller 8*a* is provided for pulling a recording paper sheet (S) out of the paper feed tray 6 and sending it forward to the second rollers 8*b*. The second rollers 8*b* are vertically arranged in facing relation to each other. With such an arrangement, the recording paper sheet (S) from the first roller 8*a* is guided between the two second rollers 8*b* to be advanced toward the third roller 8*c*.

An urging member 8*d* is arranged in facing relation to the third roller 8*c*, with the transfer path (T) extending between the urging member 8*d* and the third roller 8*c*. The urging member 8*d* is provided for bringing the recording paper sheet (S) into contact with the third roller 8*c*, so that the recording paper sheet (S) is properly advanced by the third roller 8*c* toward the printing section 7*a*. Upon completion of a print job, the recording paper sheet (S) is discharged into the stacker 9 by the sheet discharge mechanism 10.

Figure 3:
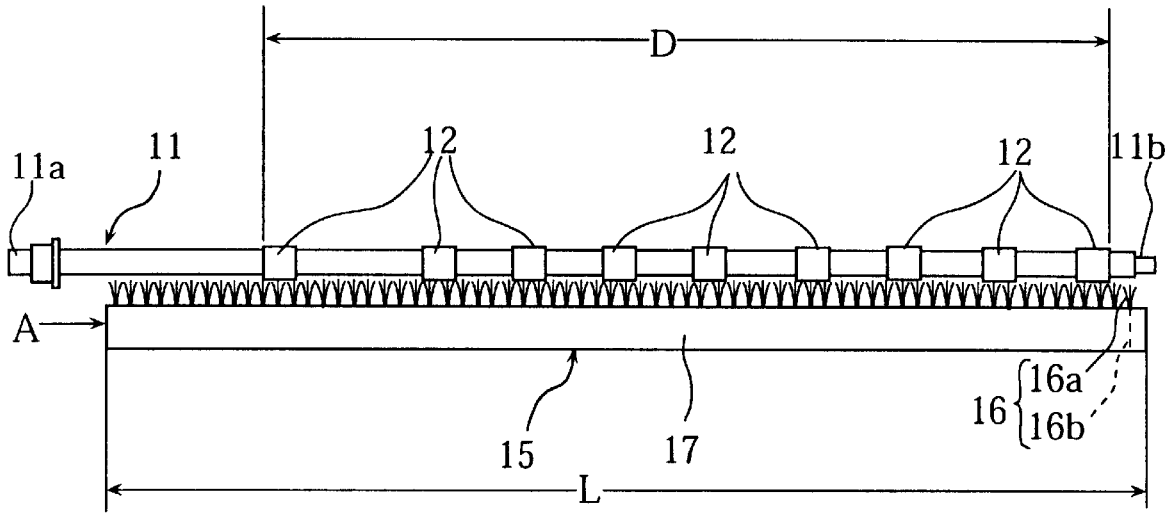
FIG. 3 shows an electric discharge brush according to the present invention, wherein the brush is held in contact with the discharge rollers.

Referring to FIGS. 2 and 3, the sheet discharge mechanism 10 includes a rotation shaft 11 extending in the transverse direction defined above. The shaft 11, which is rotatably supported by the housing 2 at its both ends 11*a* and 11*b* (FIG. 3), is externally provided with a plurality of discharge rollers 12 fixed to the shaft 11. The discharge rollers 12 may be made of an elastic material such as rubber.

As best shown in FIG. 3, the discharge rollers 12 are spaced from each other along the length of the shaft 11, and are rendered greater in diameter than the shaft 11. Since the discharge rollers 12 are fixed to the shaft 11, as previously stated, the discharge rollers 12 are rotated together with the shaft 11 when the shaft 11 is rotated by a suitable stepping motor (not shown).

The sheet discharge mechanism 10 also includes a plurality of urging members 13 rotatably supported by a supporting member 14 fixed to the housing 2. The urging members 13 may correspond in number to the discharge rollers 12. As can be seen from FIG. 2, each urging member 13 is held in facing relation to a corresponding discharge roller 12. Though not shown, each urging member 13 is formed with radially extending projections like in a spur. With such an arrangement, the recording paper sheet (S) is brought into contact with the discharge rollers 12 without fail, so that the recording paper sheet is reliably moved forward as the discharge rollers 12 rotate.

The sheet discharge mechanism 10 is further provided with an electric discharge brush 15 for removing electrostatic charge generated at the discharge rollers 12. As shown in FIG. 2, the discharge brush 15 is attached to an upright wall 2*a* of the housing 2 that extends vertically near the shaft 11 and the discharge rollers 12.

As shown in FIG. 3, the electric discharge brush 15 includes electrically conductive bristle-like members 16 (or simply called "filaments" hereinafter) grouped into a plurality of bunches. Here, it should be noted that the filaments 16 are not necessarily as stiff as bristles of a hair brush. The filaments 16 in each bunch have an upper portion 16*a* (or free end portion 16*a*) closer to the shaft 11, and a lower portion 16*b* (or stem portion 16*b*). In the illustrated embodiment, the brush is arranged near the shaft 11 so that the upper portions 16*a* of some of the filaments 16 are held in contact with the discharge rollers 12. The lower portions 16*b* are attached to a strip-like connecting base 17 made of an electrically conductive material such as aluminum and stainless steel. In this way, the respective bunches of filaments 16 are electrically connected to each other.

The length L of the brush 15 is greater than the maximum distance D between the two outermost discharge rollers 12 (see FIG. 3). Preferably, the length L is equal to or even greater than the width of the recording paper sheet (S).

Figure 4:
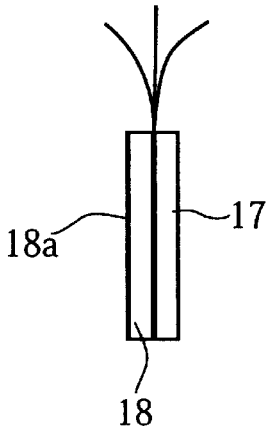
FIG. 4 is a sectional view illustrating the electric discharge brush as viewed in a direction A in FIG. 3.

The electric discharge brush 15 having the above arrangement may be attached to the wall 2*a* of the housing 2 in various ways. For instance, referring to FIG. 4 (which is a sectional view taken in a direction A in FIG. 3), use may be made of an adhesive tape 18. Specifically, the adhesive tape 18 has two surfaces (right-hand and left-hand surfaces)

which are both applied with a suitable adhesive. The right-hand surface of the tape 18 is attached beforehand to the connecting base 17, while the left-hand surface is covered by a releasable sheet 18*a*.

With such an arrangement, the electric discharge brush 15 is easily attached to the wall 2*a* simply by peeling off the releasable sheet 18*a* and pressing the exposed adhesive surface of the tape 18 onto the wall 2*a*. Of course, other fixing means such as an adhesive paste may be usable instead of the adhesive tape 18 described above.

With the electric discharge brush 15 attached to the wall 2*a* of the housing 2 as shown in FIG. 2, the brush 15 can remove the electrostatic charge generated at the surface of the discharge rollers 12. Thus, it is possible to prevent the rear end portion of the recording paper sheet (S) from being unduly drawn to the discharge rollers 12 when the rear end portion is supposed to leave the discharge rollers 12.

Further, with the use of the discharge brush 15, a space between the shaft 11 and the wall 2*a* is advantageously blocked by the upper portions 16*a* of the filaments 16.

With such an arrangement, even if the recording paper sheet (S) fails to be detached from the discharge rollers 12 and is about to be unduly moved circumferentially of the discharge rollers 12, the recording paper sheet (S) is brought into contact with the upper portions 16*a* of the filaments 16. As a result, the rear end portion of the recording paper sheet (S) will come off the discharge rollers 12 and fall into the paper stacker 9 due to gravity. For facilitating the fall, the exposed surface of the connecting base 17 is preferably smooth or slippery, so that the recording paper sheet (S) will not be caught on the exposed surface of the connecting base 17.

Figure 5:
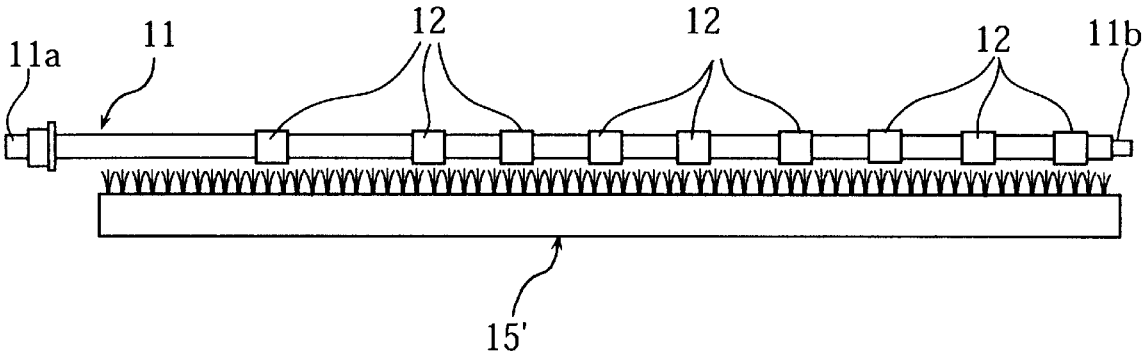
FIG. 5 shows a modified electric discharge brush according to the present invention, wherein the brush is slightly spaced from the discharge rollers.

FIG. 5 shows an electric discharge brush 15' according to a second embodiment of the present invention. The illustrated discharge brush 15' is similar to the discharge brush 15 according to the first embodiment, except that the former has conductive filaments whose upper portions 16*a*' are slightly spaced from the discharge rollers 12.

Even with such an arrangement, the electrostatic charge generated at the discharge rollers 12 is removed by the brush 15' when the spacing between the discharge rollers 12 and the filaments is sufficiently small. It is also possible to prevent improper circumferential movement of the recording paper sheet (S) around the shaft 11.

Figure 6:
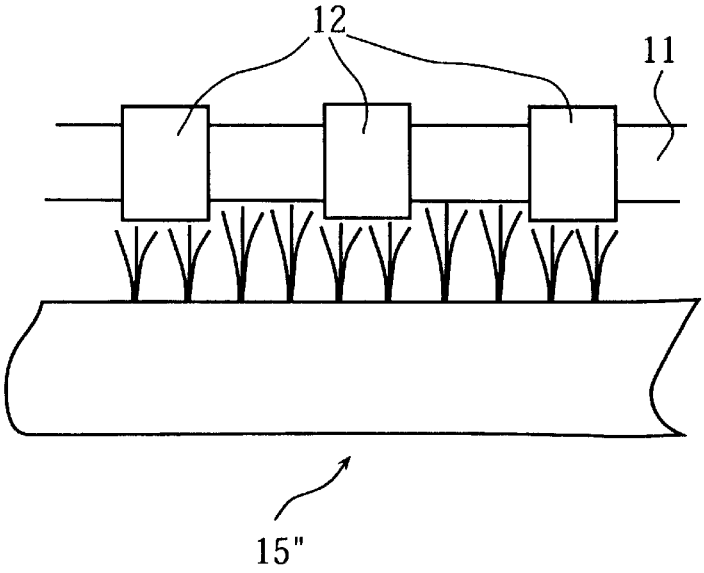
FIG. 6 shows another modified version of an electric discharge brush according to the present invention, wherein the brush includes filaments differing in length.

FIG. 6 shows an electric discharge brush 15" according to a third embodiment of the present invention. The illustrated discharge brush 15" is similar to the discharge brush 15' of the second embodiment (FIG. 5), except that the former includes electrically conductive filaments whose upper portions 16*a*" differ in length. As is shown, the upper portions 16*a*" of the filaments located between adjacent discharge rollers 12 (in other words, the filaments corresponding to exposed portions of the shaft 11) are made longer than those of the other filaments facing the discharge rollers 12.

With such an arrangement, the improper circumferential movement of the recording paper sheet (S) around the shaft 11 can be more reliably prevented than is possible with the second embodiment (FIG. 5) wherein the filaments are of the same length.

The present invention being thus described, it is obvious that the same may be varied in many ways. Such variations should not be regarded as a departure from the spirit and scope of the present invention, and all such modifications as would be obvious to those skilled in the art are intended to be included within the scope of the following claims.

We claim:

1. A sheet discharge mechanism arranged for preventing improper sheet transfer comprising:

at least one discharge roller for moving a sheet member along predetermined path;

an electric discharge brush arranged adjacent to the discharge roller but spaced from the predetermined path, the brush being provided with a plurality of filaments for removing electrostatic charge and for preventing the sheet member from being moved in an unintended direction; and a rotary shaft for carrying the discharge roller fixed thereto, wherein the filaments are divided into a first group corresponding in position to the discharge roller and a second group corresponding in position to an exposed portion of the shaft, the filaments of the first group being shorter than the filaments of the second group.

2. The sheet discharge mechanism according to claim 1, wherein the filaments of the brush are held in contact with the discharge roller.

3. The sheet discharge mechanism according to claim 1, wherein the filaments of the brush are spaced from the discharge roller.

4. The sheet discharge mechanism according to claim 1, wherein the filaments are electrically connected to each other.

5. The sheet discharge mechanism according to claim 1, wherein the brush includes an electrically conductive base for holding the filaments of the brush together.

6. The sheet discharge mechanism according to claim 5, wherein the electrically conductive base is made of aluminum and has a smooth outer surface.

7. The sheet discharge mechanism according to claim 5, wherein the electrically conductive base is made of stainless steel and has a smooth outer surface.

8. The sheet discharge mechanism according to claim 1, comprising at least two discharge rollers, wherein the brush has a longitudinal dimension which is no smaller than a maximum distance between the discharge rollers.

9. A printer for printing on sheets comprising:

a sheet feed mechanism for feeding each sheet;

a printhead for printing on said each sheet fed by the sheet feed mechanism; and a sheet discharge mechanism for discharging said each sheet; the sheet discharge mechanism comprising:

at least one discharge roller for moving said each sheet along a predetermined path;

an electric discharge brush arranged adjacent to the discharge roller but spaced from the predetermined path, the brush being provided with a plurality of filaments for removing electrostatic charge and for preventing said each sheet from being moved in an unintended direction; and a rotary shaft for carrying the discharge roller fixed thereto, wherein the filaments are divided into a first group corresponding in position to the discharge roller and a second group corresponding in position to an exposed portion of the shaft, the filaments of the first group being shorter than the filaments of the second group.

10. The printer according to claim 9, wherein the filaments of the brush are held in contact with the discharge roller.

11. The printer according to claim 9, wherein the filaments of the brush are spaced from the discharge roller.

12. The printer according to claim 9, wherein the filaments are electrically connected to each other.

13. The printer according to claim 9, wherein the brush includes an electrically conductive base for holding the filaments of the brush together.

14. The printer according to claim 13, wherein the electrically conductive base is made of aluminum and has a smooth outer surface.

15. The printer according to claim 13, wherein the electrically conductive base is made of stainless steel and has a smooth outer surface.

16. The printer according to claim 9, comprising at least two discharge rollers, wherein the brush has a longitudinal dimension which is no smaller than a maximum distance between the discharge rollers.

17. A facsimile machine incorporating a printer for printing on sheets, the printer comprising:

a sheet food mechanism for feeding each sheet;

a printhead for printing on said each sheet fed by the sheet feed mechanism; and a sheet discharge mechanism for discharging said each sheet, the sheet discharge mechanism comprising:

a least one discharge roller for moving said each sheet along a predetermined path;

an electric discharge brush arranged adjacent to the discharge roller but spaced from the predetermined path, the brush being provided with a plurality of filaments for removing electrostatic charge and for preventing said each sheet from being moved in an unintended direction; and a rotary shaft for carrying the discharge roller fixed thereto, wherein the filaments are divided into a first group corresponding in position to the discharge roller and a second group corresponding in position to an exposed portion of the shaft, the filaments of the first group being shorter than the filaments of the second group.

* * * * *